US009212484B2

(12) United States Patent
Cipriani

(10) Patent No.: US 9,212,484 B2
(45) Date of Patent: Dec. 15, 2015

(54) SUPPORT METAL STRUCTURE FOR A FALSE CEILING

(71) Applicant: Giuseppe Cipriani, Rovereto (IT)

(72) Inventor: Giuseppe Cipriani, Rovereto (IT)

( * ) Notice: Subject to any disclaimer, the term of this patent is extended or adjusted under 35 U.S.C. 154(b) by 0 days.

(21) Appl. No.: 14/354,546

(22) PCT Filed: Nov. 7, 2012

(86) PCT No.: PCT/IB2012/056221
§ 371 (c)(1),
(2) Date: Apr. 25, 2014

(87) PCT Pub. No.: WO2013/068937
PCT Pub. Date: May 16, 2013

(65) Prior Publication Data

US 2015/0121800 A1 May 7, 2015

(30) Foreign Application Priority Data

Nov. 11, 2011 (WO) ..... PCT/IB2011/055051

(51) Int. Cl.

| | |
|---|---|
| ***E04B 9/00*** | (2006.01) |
| ***E04B 9/06*** | (2006.01) |
| ***E04B 9/10*** | (2006.01) |
| ***E04B 9/12*** | (2006.01) |

(52) U.S. Cl.
CPC . *E04B 9/068* (2013.01); *E04B 9/10* (2013.01); *E04B 9/122* (2013.01); *E04B 9/127* (2013.01)

(58) Field of Classification Search
CPC ..... E04B 9/068; E04B 9/127; E04B 9/10; E04B 9/12; E04B 9/122
USPC ..... 52/506.06, 506.07
See application file for complete search history.

(56) References Cited

U.S. PATENT DOCUMENTS

| | | | | |
|---|---|---|---|---|
| 3,312,488 | A | 4/1967 | Lickliter et al. | |
| 5,271,202 | A * | 12/1993 | Vukmanic et al. | 52/667 |
| 5,687,525 | A * | 11/1997 | Koski et al. | 52/506.07 |
| 6,138,416 | A * | 10/2000 | Platt | 52/28 |
| 8,715,427 | B2 * | 5/2014 | Vandeputte et al. | 148/320 |
| 2003/0200719 | A1 | 10/2003 | Harcula et al. | |

FOREIGN PATENT DOCUMENTS

| | | |
|---|---|---|
| EP | 1239095 | 9/2002 |
| EP | 2447434 | 5/2012 |
| GB | 1369234 | 10/1974 |
| WO | 99/46460 | 9/1999 |
| WO | 2012/118223 | 9/2012 |
| WO | 2013/175268 | 11/2013 |
| WO | 2014/016648 | 1/2014 |

OTHER PUBLICATIONS

PCT International Search Report mailed on Jul. 12, 2013 for PCT Application PCT/IB2012/056221 filed on Nov. 7, 2012 in the name of Giuseppe Cipriani.

(Continued)

*Primary Examiner* — Adriana Figueroa
(74) *Attorney, Agent, or Firm* — Steinfl & Bruno LLP

(57) ABSTRACT

A steel article for false ceilings or for supporting false ceilings and process for making the article is described. The article has the following combination of features: maximum tensile strength Rm greater than 500 N/mm$^2$ and elongation from 0% to 15%.

19 Claims, 6 Drawing Sheets

(56) References Cited

OTHER PUBLICATIONS

PCT Written Opinion mailed on Dec. 2, 2013 for PCT Application PCT/IB2012/056221 filed on Nov. 7, 2012 in the name of Giuseppe Cipriani.
PCT Written Opinion mailed on Jan. 22, 2014 for PCT Application PCT/IB2012/056221 filed on Nov. 7, 2012 in the name of Giuseppe Cipriani.
PCT International Preliminary Report on Patentability mailed on Apr. 10, 2014 for PCT Application PCT/IB2012/056221 filed on Nov. 7, 2012 in the name of Giuseppe Cipriani.
PCT International Search Report mailed on Jul. 26, 2012 for PCT Application PCT/IB2011/055051 filed on Nov. 11, 2011 in the name of Giuseppe Cipriani.
SSAB Swedish Steel Group. "It's All About Strength and Lightness." DOCOL. 32 pgs. Aug. 2008.
DOCOL—High Strength Steel. "Docol Roll—Cold rolled high strength steel for roll forming." 2 pgs. Apr. 9, 2011.
World Auto Steel. Advanced High Strength Steel (AHSS) Application Guidelines. Version 4.1. 338 pgs. Jun. 8, 2009.
Masaaki, M. et al. "Method for Bending Sheet Metal and Product of Sheet Metal." Translation of specification WO2012118223 (A1) published on Sep. 7, 2012.
Response to Written Opinion dated Nov. 14, 2013 for PCT Application PCT/IB2012/056221 filed on Nov. 7, 2012 in the name of Giuseppe Cipriani.
Response to Written Opinion dated Mar. 7, 2014 for PCT Application PCT/IB2012/056221 filed on Nov. 7, 2012 in the name of Giuseppe Cipriani.
Manfrin, M. "To: Ms. Manfrin—Application of Cipriani Giuseppe—your ref BW74E/EMM/emm." Email to Jan Demeester. Mar. 13, 2014.
Demeester, J. "To: Ms. Manfrin—Application of Cipriani Giuseppe—your ref BW74E/EMM/emm." Email to Marta Manfrin. Mar. 13, 2014.
PCT Written Opinion mailed on Jul. 12, 2013 for PCT Application PCT/IB2012/056221 filed on Nov. 7, 2012 in the name of Giuseppe Cipriani.
PCT Written Opinion mailed on Jul. 26, 2012 for PCT Application PCT/IB2011/055051 filed on Nov. 11, 2011 in the name of Giuseppe Cipriani.
1-First Office Action issued for Chinese Patent Application No. 201280059686.0 filed in Giuseppe Cipriani. 10 pgs. Mail date: Jul. 15, 2015 (English Translation pp. 1-3 + Original).
2-Office Action issued for Chilean Patent Application No. 1180-2014 filed in the name of Giuseppe Cipriani. 13 pgs. Date: Apr. 1, 2015 (English Summary + Original Office Action).

* cited by examiner

SUPPORT METAL STRUCTURE FOR A FALSE CEILING

CROSS REFERENCE TO RELATED APPLICATIONS

The present application is the US national stage of International Patent Application PCT/IB2012/056221 filed on Nov. 7, 2012 which, in turn, claims priority to International Patent Application PCT/IB2011/055051 filed on Nov. 11, 2011.

The present disclosure generally refers to the field of support structures, or load-bearing structures for false ceilings, i.e. support structures for plates or panels, e.g. modular ones, placed underneath a regular ceiling, which are connected to the ceiling by a so-called hanger, steel rods, a wire, section bars or other coupling articles.

Support structures for false ceilings comprise a frame intended for supporting or propping of panels or plates, in which the frame includes metal section bars fixed and crossed by a special joint to ideally form a grid, the grid defining a support plane for the panels or plates.

Even more specifically, the present disclosure relates to a steel article for a false ceiling, like, for example, a metal section bar, and a process for the manufacturing of the steel article.

It is known that a metal section bar for support structures of false ceilings is an article of elongated shape having a T-shaped section, or other shape suitable for a false ceiling, for instance a modular false ceiling, in which the section bar is obtained by folding of a sheet metal or strip. The sheet metal is folded on itself to form an overlap of two portions of sheet metal, such as to define adjacent and/or side-by-side sheet metal portions.

In practice, the metal section bar includes at least two sheet metal portions, or walls, side-by-side and/or overlapped along a longitudinal direction of the section bar.

In the above-mentioned field, it is also known the need to use sheet metals for the manufacturing of metal section bars that be made of a material as light-weight as possible and of reduced thickness, so as to least affect support structure weights and cost.

However, the use of light-weight materials is incompatible with the possibility of ensuring sufficient performances of mechanical strength and of stability of the metal section bar once installed. In particular, a section bar having a thickness lower than 0.25 mm does not ensure satisfactory strength for a connection with a clip. In addition, the Inventor of the present disclosure has recognized that a double-wall section bar, in which two thicknesses, for instance, of 0.25 mm or more, overlap, does not have the same mechanical strength of a single-wall section bar having a thickness equal to the sum of the two thicknesses, whose mechanical strength is much higher. It follows that, up to now, the possibility and the perspective of further reducing the thickness of the section bar, above all in a double-wall section bar, did not appear successful.

Moreover, by the Inventor of the present patent application it has been recognized that, below 0.25 mm of thickness, other problems of mechanical resistance can occur; for instance, torques can be generated, as highlighted in the International patent application PCT/IB2012/053862, to the same holder of the present patent application.

In addition, at the basis of the present disclosure there is the further recognition by the Inventor that it is possible to reduce the thickness of the section bar and, at the same time, obtain a sufficient mechanical performance, thanks to the use of a specific steel material up to now never used, in the opinion of the Inventor of the present disclosure, in the field of section bars for false ceilings.

Therefore, the present disclosure is based on the technical problem of providing a steel article for false ceilings allowing to overcome the drawbacks mentioned above with reference to the known art, and/or attain further advantages or features, in particular allowing to maintain reasonable costs and weights.

Such a technical problem can be solved by a steel article, a combination of a section bar for a false ceiling and a clip, a support structure for a false ceiling according to claim, and a process according to the claims. Specific embodiments of the subject-matter of the present disclosure are set forth in the corresponding dependent claims.

In particular, it is provided a steel article for a false ceiling having a combination of the following mechanical properties:

- Maximum tensile strength Rm greater than 500 N/mm$^2$; and
- elongation lower than or equal to 15%, i.e. ranging from 0 to 15%.

With reference to the above-reported features, it is specified that the meaning conventionally recognized in the mechanical field should be attributed thereto. In particular, the term "maximum tensile strength" signifies maximum strength to yield point of a material. The term "elongation" signifies steel elongation to yield point of a material. This data characterizes, in part, steel deformation ability.

It follows that, on the basis of said features of reduced elongation ability and high yield strength, the steel article according to the present disclosure has high abilities of elastic return.

In an embodiment of the present disclosure, the steel article according to the present disclosure has a maximum tensile strength Rm of from 650 to 850 N/mm$^2$ and/or an elongation ranging from 1 to 12%.

In an embodiment of the present disclosure, the steel article according to the present disclosure has an elongation ranging from 2 to 8%.

It is noted that in the steelmaking field it is possible to find plants adequate for providing, on the basis of specific technical demands, a steel having said mechanical features.

Even more specifically, the Inventor of the present patent application, on the basis of knowledge in galvanization plants and related thermal cycles, has had the intuition that, by using a steel having these features, it is possible to provide a section bar for a false ceiling having a greatly reduced thickness, and at the same time of high strength. In other words, the Inventor of the present patent application has had the intuition that a steel section bar having the above-mentioned mechanical features can have a reduced thickness, which does not nullify the mechanical performances of a section bar.

In an embodiment of the present disclosure, the steel is a non-stainless steel, for example comprising a zinc-based coating or a zinc alloy-based coating. Alternatively, the steel can comprise an aluminum-based coating or a coating based on aluminum-related alloys, or it can be a painted steel, or be differently coated. Alternatively, in case of low-level making, the steel is not coated.

Such a steel is very different from a steel currently used in the field, usually called DX51 D steel, or from other forming-specific steel, which has the following features:

- maximum tensile strength Rm of 270 to 500 N/mm$^2$, and more specifically usually ranging from 350 to 380 N/mm$^2$; and
- elongation greater than 22%, and more specifically usually ranging from 25 to 30%.

In fact, it is observed that the steel according to the present disclosure has a maximum tensile strength almost twice that well-known material to be applied in the field of section bars for false ceilings. In this connection, it should be noted that the material subject-matter of the present disclosure is so different from that normally used up to now in the field of false ceilings, that adequate sheet metal forming and pressing equipment had to be used in order to obtain the section bars for false ceilings according to the present disclosure. The need for a change in equipment is mainly due to the fact that the material subject-matter of the present disclosure has a greatly reduced elongation ability.

Moreover, as disclosed above, it is observed that, with respect to the possibility of having modest deformations of the section bar (reduced elongation) with increased strength, for the section bar it is possible to use a material having a thinner thickness, though maintaining system performances which are the same, or with superior properties.

In particular, to ensure the obtainment of a section bar, for instance a double-wall one, or of a similar article for false ceilings, of a thickness reduced even of the order of 0.10 mm-0.20 mm, the Inventor of the present disclosure has discovered the need for the steel mill to avail itself of a plant with an adequate thermal and cleaning cycle, prior to a galvanization step.

In particular, a starting article, as for instance a strip, is subjected to a specific treatment, which envisages a cold cleaning and a subsequent low-temperature annealing treatment, for instance at 450° C. to 520° C.

Moreover, with regard to double-wall section bars, in order to overcome torque increase caused, as disclosed above, by thickness decrease, it is adopted the technical solution described and claimed in the above-mentioned International patent application PCT/IB2012/053862, to the same holder of the present patent application, and incorporated herein by reference.

However, it should be understood that, in order to satisfy specific needs of high mechanical strength, it is possible to provide articles for false ceilings having a relatively higher thickness, even of above 0.25 mm.

According to some further embodiments of the present disclosure, taking into account the above-reported mechanical properties of a section bar for false ceilings, the Inventor of the present disclosure has discovered the expediency or possibility of associating the section bar to a clip or connection article which may be deformed in order to make the connection with the section bar. In particular, the inventor has discovered the expediency of using a clip having elongation ability greater than the section bar. In particular, according to these further embodiments of the present disclosure, the clip has a deformed sheet metal portion, for example deep-drawn, that surrounds at least partially a hole intended for the connection to the metal section bar, wherein said deep-drawn sheet metal portion is adapted to be riveted after having been inserted in a corresponding hole of the metal section bar.

Said clip can be made from a material with good elongation property (therefore that can be deep-drawn) and high strength and tensile strength (therefore with a spring effect necessary for the coupling function in the slit of another clip or of another section bar).

In an embodiment, a suitable material for the clip was found to be the stainless steel that combines both advantages.

In other exemplary embodiments, other materials having the above-mentioned features of good elongation property (therefore that can be deep-drawn) and high strength and high tensile strength have been used for making the clip.

It may be noted that the deformed or deep-drawn sheet metal portion of the clip, intended to be riveted on the section bar, is part of the clip itself. It follows that, after the riveting on the section bar, the major load due to the connection with the section bar weighs on the clip, and is carried by the latter, so as not to burden the section bar. It further follows that, in some embodiments, the connection article or clip can be fixed to a metal section bar being of reduced thickness but of high tensile strength, (in fact, the section bar does not need to be deformed or deep-drawn), and then, the material being equal, of reduced weight. For example, there is the possibility of reducing the thickness of the material used to produce the section bar, for instance saving 20% or more material, with respect to a known-art section bar.

In this respect it is found that, in the opinion of the author of the present disclosure, in the field of articles for false ceilings the combination of a stainless steel clip with a non-stainless steel section bar being of a hardness/tensile strength greater than or similar/comparable to that of the clip, and of reduced elongation, is totally new.

It follows that, in case a clip is made of stainless steel, which, as is known, is a valuable material, a possible cost of this valuable material is far compensated by the saved thickness of the material used for the section bar. It further follows that it is possible to have a combination of a stainless steel clip with a non-stainless steel section bar having a weight remarkably reduced with respect to the known art.

It is also to be noted that, in relation to the production, a further advantage lies in the fact of not necessarily having to replace moulds and punches to vary the thickness of the various types of section bar produced, since the thickness of the clip, which is the part to be deformed, i.e., the material "to be machined", can remain unchanged.

According to some further embodiments of the present disclosure, the use of a material for the section bar with a high elastic return solves, if necessary, a possible problem of having to apply on the section bar a clip with elastic properties (and therefore, for instance, a stainless steel clip). Said performance is necessary for a connection of the clip in the slit of another section bar, as for instance described in the International patent application PCT/IB2012/052560 to the same holder of the present patent application, and incorporated herein by reference.

In this respect, according to said further embodiments of the present disclosure, in order to exploit the elastic properties already present in the material of the section bar, the clip or connection article is an integral part of the section bar, to define an integral coupling element. In other words, the connection article is formed integrally or in one piece with the section bar, and therefore it is not applied. It follows that the integral coupling element is formed from the same above-described material of the section bar, and exploits its elastic properties.

Other features and the operation modes of the subject-matter of the present disclosure will be made evident from the following detailed description of embodiments thereof, given by way of a non-limiting example.

It is also to be understood that all possible combinations of embodiments described with reference to the following detailed description fall within the scope of the present disclosure.

Reference will be made to the figures of the annexed drawings, wherein:

FIGS. 1 and 2 schematically show a perspective view of a support structure for false ceilings;

Figure 1:
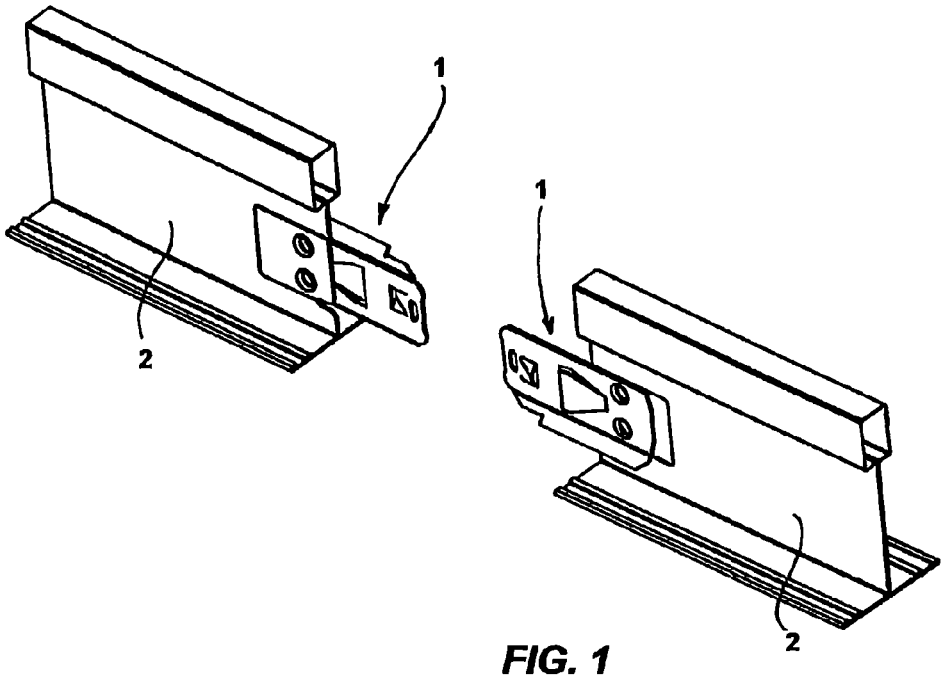
Figure 2:
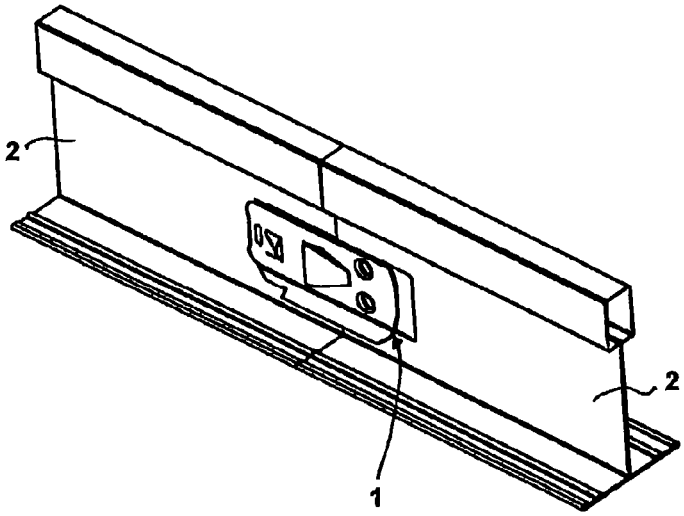
Figure 3:
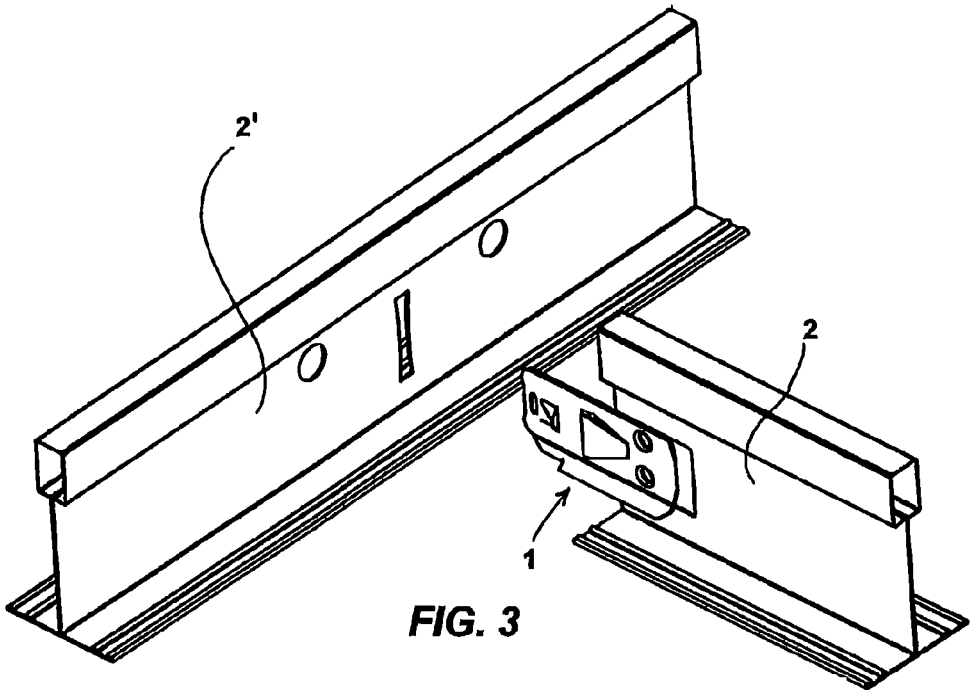
FIGS. 3 and 4 show perspective views of a further support structure for false ceilings.
Figure 4:
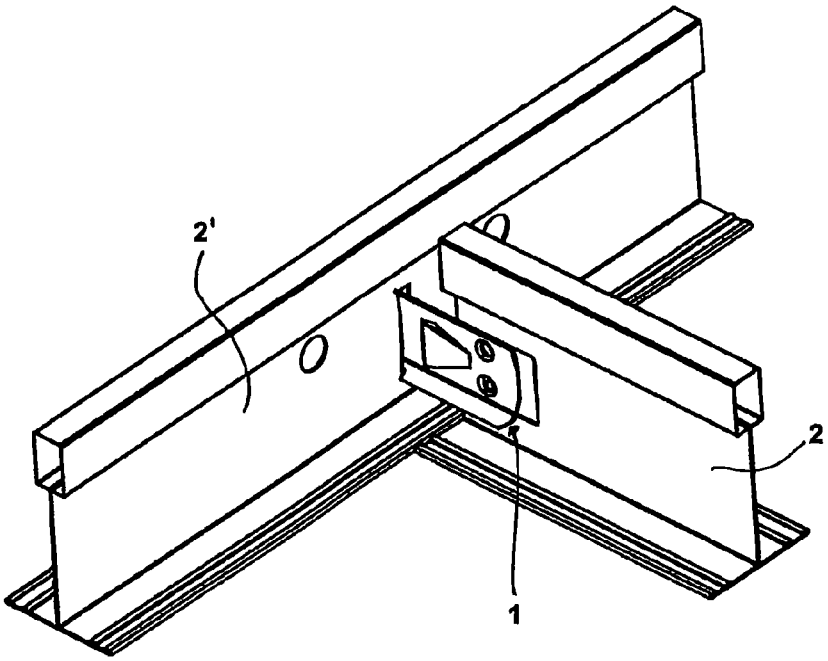
Figure 6:
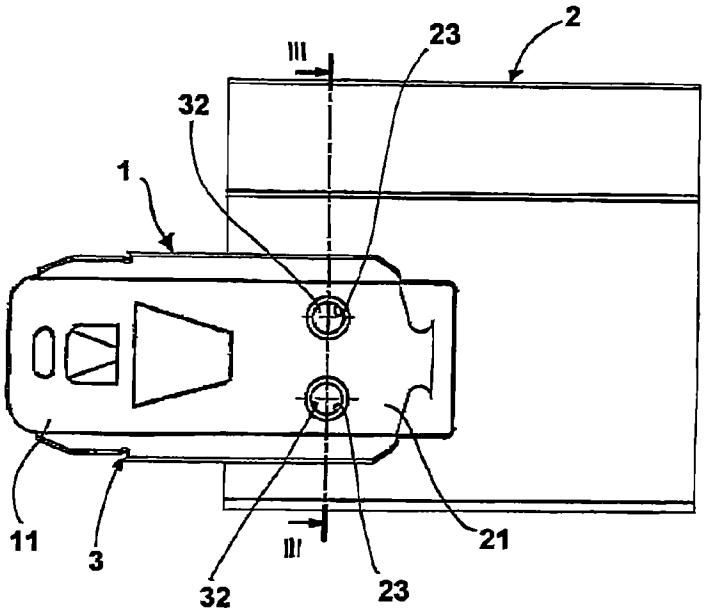
FIG. 6 shows a side view of a connection article associated to a section bar according to the present disclosure.
Figure 5:
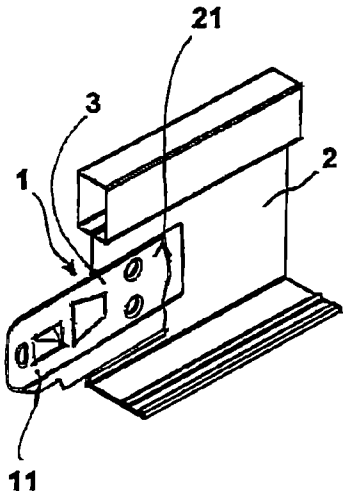
FIG. 5 shows a perspective view of a connection article associated to a section bar according to the present disclosure.

With reference to the annexed figures, a metal section bar according to the present disclosure is denoted by number 2. The metal section bar 2 is connected to a clip 1 or connection article (FIGS. 1-8, 11-12), or includes an integral coupling element 101 (FIGS. 9-10), to define a propping frame of a support structure for a false ceiling according to the present disclosure.

The clip 1, which will be described more specifically in the following, is fixed to one end of the metal section bar 2. As shown in FIGS. 1-4, the clip 1 can be used for the connection to another clip, which is in turn fixed to a metal section bar, or it can be inserted in a slit of a further metal section bar 2' (FIGS. 3 and 4), to form a support or propping structure for a false ceiling.

Alternatively, in an embodiment shown by way of example in FIGS. 9 and 10, and FIGS. 11 and 12, in said slit of the metal section bar 2', two clips 1 or two integral coupling elements 101 are inserted from opposite sides, the two clips or the two coupling articles being in turn associated to the respective section bar 2 to form a crosswise structure.

Figure 8:
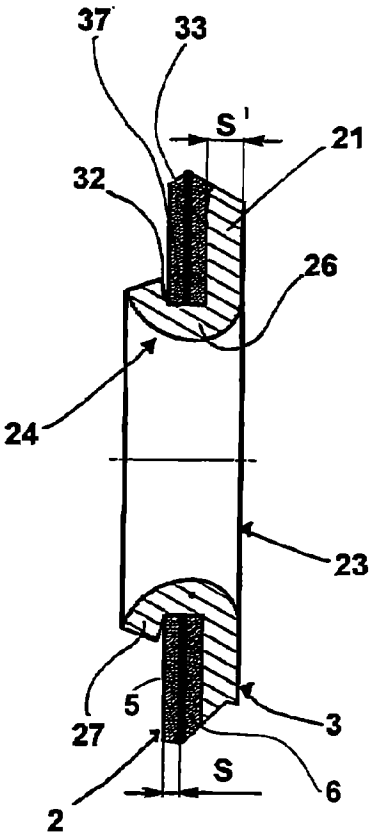
FIG. 8 shows a detail IV of FIG. 7.
Figure 7:
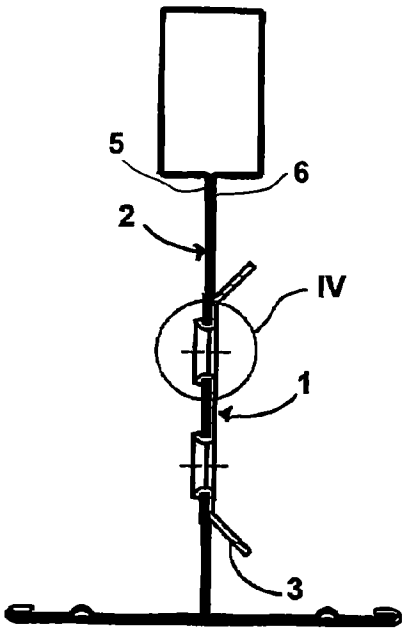
FIG. 7 shows a sectional view along line III-III of FIG. 6.

The metal section bar 2 has, in the example, a T-shaped section, and is obtained by folding a sheet metal, in order to obtain an overlap of at least two sheet metal portions 5, 6 (FIGS. 7 and 8). The metal section bar 2 can be different from the one illustrated, for instance of different section, but anyhow suitable for the false ceiling field.

In particular, according to an embodiment of the present disclosure like the one illustrated in the figures, the metal section bar 2 includes at least two sheet metal portions 5, 6, or walls, side-by side and/or overlapped, as shown for instance in FIGS. 7 and 8. The two sheet metal portions 5, 6 can be adherent the one on the other.

The metal section bar 2 extends along a prevalent direction, also called longitudinal direction. In other words, the metal section bar is an elongated body in which there can be seen a long side, extended in said longitudinal direction, and a short side, extended transversally with respect to the long side.

According to an aspect of the present disclosure, the metal section bar 2 has the following mechanical features:

maximum tensile strength Rm greater than 500 $N/mm^2$, more specifically 500 $N/mm^2$ to 1000 $N/mm^2$; and elongation of from 0% to 15%.

In practice, the metal section bar has high hardness and low elongation. In an embodiment of the present disclosure, the metal section bar 2 has the following mechanical features:

maximum tensile strength Rm: 650 to 850 $N/mm^2$; and elongation of from 1% to 12%, or elongation of from 2% to 8%.

wherein said mechanical features proved capable of attaining the best results. It is therefore a steel section bar having a reduced elongation and high strength, with a consequent high elastic return.

The steel can be zinc-coated (galvanized) steel, non-stainless steel, or painted steel, or differently coated steel. In embodiments, for productions of lower grade and cost, the steel is not coated.

Thanks to the fact that the metal section bar has said mechanical features of high mechanical strength and low elongation, it is possible to use a metal section bar of greatly reduced thickness, as will be explained in the following, which is suitable for undergoing machining, like deforming or deep-drawings carried out with specific equipment, without nullifying the mechanical performances of the installed section bar when mounted in a false ceiling.

In particular, according to a further aspect of the present disclosure and according to some embodiments of the present disclosure, like the ones shown in FIGS. 1-8, 11-12, the deforming and deep-drawing machining are mainly carried out on the clip 1, which has greater elongation ability than the section bar 2. The clip 1 can be of stainless steel, and is then coupled to a non-stainless steel section bar.

In particular, the clip 1 includes a plate sheet metal body 3 formed by a first clip portion 11, including a slit intended for connection through retainers and fins with another clip, or with said slit or slot of the section bar 2', or with another connection article (not illustrated) and a second portion 21 intended for connection and fixing to the section bar 2.

The present disclosure relates in particular to the second portion 21 for connection with the metal section bar 2; it follows that, in the following description the first portion 11 will not be described, it being understood that it can be made with slits, retainers, fins or other types of connection elements according to the needs for connection with another clip or another section bar.

The second portion 21 comprises at least one hole 23, in the example two through holes 23, for the connection with the section bar 2. The metal section bar 2 includes in turn two through holes 32.

In the exemplary embodiment the holes 23, 32 are circular. It should be understood that they can be of any other shape and size.

The two through holes 23 of the clip 1 are identical to each other. The two through holes 32 of the metal section bar 2 are also identical to each other. Therefore in the following, reference will be made to only one hole 23 of each clip 1 and only one hole 32 of the metal section bar 2, it being understood that such description is valid for all through holes 23 of the clip 1 and through holes 32 of the metal section bar 2.

In particular, according to an aspect of the present disclosure and according to some embodiments of the present disclosure like the ones shown in FIGS. 1-8, 11-12, the clip 1 includes a deformed sheet metal portion, in the illustrated example deep-drawn 24, that surrounds the hole 23 and that protrudes with respect to one face 33 of the plate sheet metal body 3. Said deep-drawn sheet metal portion 24 defines a projection with respect to the face 33 of the plate sheet metal body 3 of the clip 1. The deep-drawn sheet metal portion 24 is intended to be inserted in a corresponding through hole 32 of the section bar 2, and therein riveted against the section bar 2.

When fixed to the metal section bar 2, the deep-drawn sheet metal portion 24, has an insertion clip portion 26 received in the through hole 32 of the section bar 2, and a riveted clip portion 27 that protrudes radially with respect to the insertion portion 26.

More specifically, in the embodiment illustrated in FIGS. 5-8, the section bar 2 has a piece of flat sheet metal 37 adjacent to the hole 32; it follows that, after the connection, the riveted clip portion 27 overcomes and exerts a stable pressing contact on the flat piece of sheet metal 37 of the section bar 2, ensuring a stabile connection.

Moreover, in the exemplary embodiment of FIGS. 5-8, the deep-drawn sheet metal portion 24 of the clip 1 has substantially the shape of a collar or a cylindrical shape. It follows that, after the riveting, the riveted clip portion 27 has the shape of a crown.

In other embodiments not illustrated, the deep-drawn sheet metal portion 24 can have a different shape from the cylindrical shape, for instance it may consist of separate blades, or similar fins, intended to be riveted.

Figure 9:
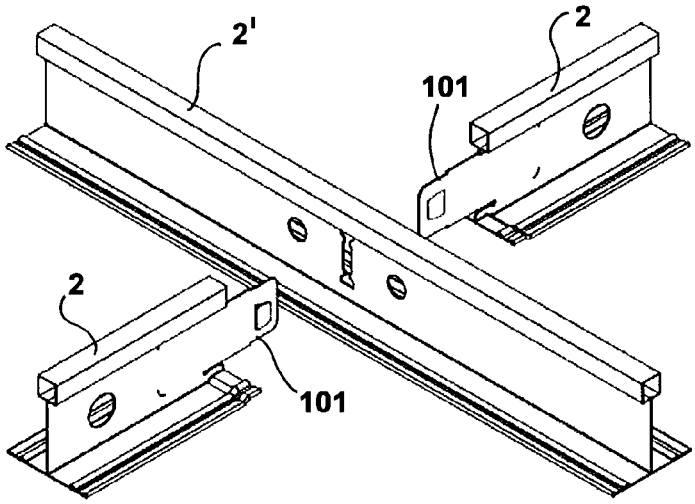
FIGS. 9 and 10 show a perspective view of a support structure for false ceilings according to an embodiment of the present disclosure.
Figure 10:
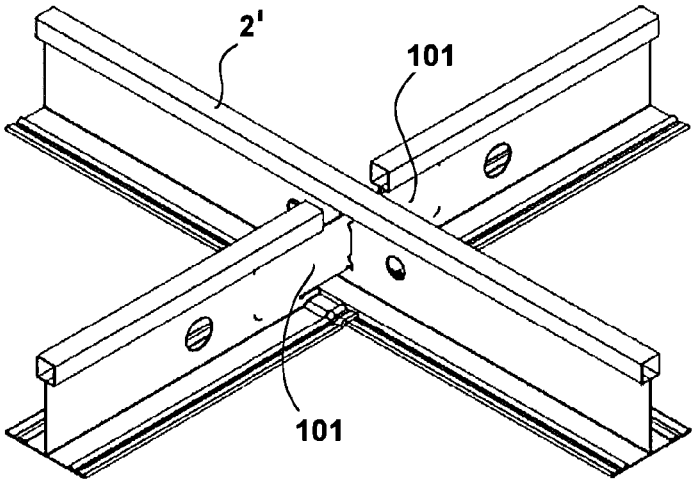
Figure 11:
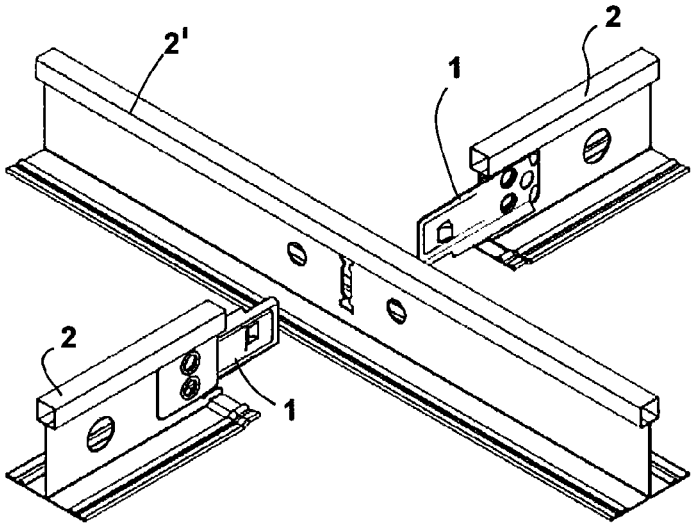
FIGS. 11 and 12 show a perspective view of a support structure for false ceilings according to an embodiment of the present disclosure.
Figure 12:
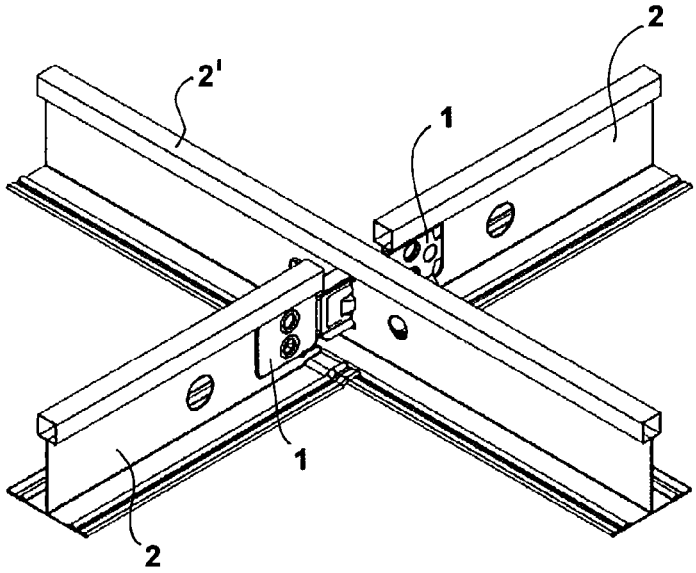

According to some alternative embodiments of the present disclosure, as for instance the embodiment illustrated in FIGS. 9-10, in place of the connection article 1 or clip, it is provided an integral coupling element 101, which is an integral part formed as one piece with the section bar 2. It follows that the integral coupling element 101 includes all above-reported mechanical features and properties of the section bar 2, i.e. reduced elongation, and high strength and high elastic return. The integral coupling element 101 can be suitable for a connection to the section bar 2' as described in the above-mentioned International patent application PCT/IB2012/052560.

According to another aspect of the present disclosure a process for fixing a clip 1 or connection article to a metal section bar of a support structure for a false ceiling, having the above-mentioned mechanical features is described.

Said process provides a preliminary step for preparing the metal section bar. Said preliminary step includes a step of providing a steel article, as for instance a steel strip, having the following features:

- maximum tensile strength Rm greater than 500 N/mm$^2$, for instance 500 to 1000 N/mm$^2$, even more specifically 650 to 850 N/mm$^2$;
- elongation lower than 15%, i.e., from 0% to 15%, even more specifically from 1% to 12%, or from 2% to 8%.

In accordance with said properties, the steel strip can have a greatly reduced thickness, of the order of 0.10-0.20 mm, which is suitable for the field of section bars for false ceilings.

In particular, in some embodiments, for low-level productions, the (crude rolled) strip is machined tel quel, as is output from the rolling mill, to obtain the section bar.

In other embodiments, the strip is coated, e.g., zinc-coated (galvanized). In particular, prior to galvanizing the steel strip undergoes a specific thermal cycle.

Even more specifically, the steel strip undergoes a thermal cycle including a maintenance cycle (at 450° C.) and/or a modest annealing (520° C.) to obtain a crude or little-annealed strip.

By way of information it is observed that the thermal cycle is based on a process referred to as "Sendzimir-type galvanizing" in the field, still currently in use, in honor of first prototypes of continuous galvanization plants created in the 1930s by T. K. Sendzimir. This process initially consisted in the preliminary burning of a cold-rolled strip in an oxidizing free-flame furnace to volatilize rolling oil residues and produce a thin surface oxide layer. Subsequently, annealing at about 900° was carried out under a highly aggressive reducing Nitrogen-Hydrogen atmosphere obtained from pyrolyzed ammonia that pickled, thanks to the high temperatures, the oxide present on the strip.

Therefore, it was not possible to successfully galvanize crude strips without annealing them.

Around the 1970s a new type of furnace departs from Sendzimir principles by making use of special non-oxidizing burners for direct-flame cleaning of the strip. A further improvement is obtained with non-oxidizing vertical furnaces for surface preparation. With this type of furnace it is attained a good flexibility in temperatures required by the various thermal cycles, enabling annealing from 520° to 850° or more, and therefore it is possible to obtain crude and half-crude products, however still not in the thicknesses of interest as indicated in some embodiments of the present disclosure. In fact, the need to obtain crude or little-annealed galvanized products of extra-thin thickness (0.10-0.20 mm), impossible to obtain with traditional furnaces only, is relatively recent.

It was important to understand, for the application field (false ceilings) of the present disclosure, that the first part of strip cleaning represents a critical part of the process, since cold reduction is contaminated by rolling oils and oxide layers. It is of vital importance, for the correct interstitial forming of the Iron/Zinc alloy, that these contaminants be removed from the strip, as it is crucial to present a perfectly cleaned surface to the molten bath to obtain acceptable adherence in the zinc-coating step.

In order to make steel strips suitable for articles for false ceilings, as for instance section bars according to the present disclosure, specific steelmaking plants have been selected which obtain the cleaning with a cold process prior to the inletting in the galvanization plant. Thus, direct-flame heating for the cleaning is definitely facilitated, and on these thicknesses the plant can run at lower temperatures, as is technically convenient for thicknesses so reduced. The various steps comprise an electrolytic or ultrasonic degreasing in special hot-bath solutions, with subsequent washing and rinsing in hot water. Here, all oily fractions from rolling are removed. Subsequently, to remove surface oxides the strip transits in a pickling of diluted and hot hydrochloric acid (HCl) in a suitable vat, hermetically sealed to suck up and abate corrosive HCL fumes. A last washing in hot water at compensated PH ends the preparing of the strip, which is ready to be zinc-coated (galvanized). It is possible to also carry out a bland annealing to obtain a minimum deformability of the product according to the end use.

After having obtained the galvanized strip of reduced thickness and having the above-mentioned mechanical features, the strip is subjected to a forming or pressing with specific plants, to obtain a section bar ready for use.

In an embodiment of the present disclosure, like the one shown in FIGS. 1 to 8, it is further provided a step wherein a part of the clip is deformed around a through hole 23 of the clip 1 intended for connection with the metal section bar 2, to determine, for instance, a deep-drawn sheet metal portion 24.

It has to be noted that thanks to the properties of hardness and strength of the material of the section bar 2, when a punch is operated for deep-drawing the clip 1 against section bar 2, the latter undergoes no deformation.

The deep-drawn sheet metal portion 24 has for instance substantially a cylindrical shape or the shape of a collar.

In a first exemplary embodiment, the clip 1 is connected to a section bar 2 having a flat piece of sheet metal 37, as shown in FIG. 8. It follows that after insertion, the deep-drawn sheet metal portion 24 is riveted to the section bar 2 to obtain a connection like the one illustrated in FIG. 8, without, as mentioned, creating deformations.

Subsequently, a free end edge of the deep-drawn sheet metal portion 24 of the clip 1 is riveted on the other side of the metal section bar 2, to form a riveted clip portion 27

The riveted clip portion 27 overcomes and surmounts the respective section bar portion 2.

A very stable connection is obtained by riveting the deep-drawn sheet metal portion 24 of the clip 1. It may be observed that such connection is independent from the thickness S of the section bar 2, which can be greatly reduced, for instance lower than or equal to 0.25 mm or less, up to 0.10 mm. The clip 1 may have a higher thickness S', which can be of 0.4 mm for instance.

It is to be noted that thanks to the use of reduced thickness S, if necessary or required, for the clip 1 more valuable materials having features of higher hardness and yield strength can be used, without affecting significantly the costs of the metal section bar.

In other embodiments of the present disclosure, in order to satisfy specific needs of higher load-bearing capacities, it is possible to exploit the improved mechanical properties of the novel article for false ceilings according to the present disclosure, even for thicknesses greater than 0.25 mm.

In an embodiment of the present disclosure, as illustrated in FIGS. 9 and 10, in place of the clip 1 applied to the section bar 2, an integral coupling element 101 is provided, integrally formed as one piece with the section bar 2 at forming, from a single strip according to the above-described galvanizing process. Accordingly, being the integral coupling element 101 one piece with the section bar 2, no machining on a separate clip is required. The integral coupling element 101 of this alternative embodiment has the same features of elastic return of the section bar 2 and can be connected to the section bar 2' by exploiting said elastic properties.

The subject-matter of the present disclosure has hereto been described with reference to preferred embodiments thereof. It is understood that there may be other embodiments referable to the same inventive concept, all falling within the protective scope of the claims set forth hereinafter.

The invention claimed is:

1. A T-shaped steel section bar for a support structure for false ceilings or for supporting false ceilings, wherein the T-shaped steel section bar is made of a zinc coated galvanized steel strip or zinc coated galvanized steel sheet metal of thickness equal to or lower than 0.25 mm, wherein the steel presents the following combination of features:

maximum tensile strength Rm from 500 N/mm$^2$ to 1000 N/mm$^2$; and elongation from 2% to 8%.

2. The T-shaped steel section bar for a support structure according to claim 1, wherein said maximum tensile strength RM ranges from 650 N/mm$^2$ to 850 N/mm$^2$.

3. The T-shaped steel section bar for a support structure according to claim 1, wherein the steel is non-stainless steel.

4. The T-shaped steel section bar for a support structure according to claim 1, wherein the zinc coated galvanized steel strip or the zinc coated galvanized steel sheet metal includes a steel strip or steel sheet metal and a zinc coating applied on a surface of the steel strip or the steel sheet metal and wherein the surface of the steel strip or of the steel sheet metal is devoid of any oil exposed to the zinc coating.

5. The T-shaped steel section bar for a support structure according to claim 1, wherein the zinc coated galvanized steel strip or the zinc coated galvanized steel sheet metal includes a steel strip or steel sheet metal and a zinc coating applied on a surface of the steel strip or the steel sheet metal and wherein the surface of the steel strip or of the steel sheet metal is devoid of any oxides exposed to the zinc coating.

6. The T-shaped steel section bar for a support structure according to claim 1, wherein the section bar comprises an integral coupling element integrally formed as one piece with the T-shaped section bar configured to be directly joined to another metal section bar.

7. The T-shaped steel section bar for a support structure according to claim 1, wherein said section bar is of shape elongated along a longitudinal direction and includes at least two sheet metal or strip portions, side-by-side, or overlapped, the one with the other in said longitudinal direction, and wherein each of the two side-by-side, or overlapped sheet metal or strip portions includes an end portion provided with at least one corrugation.

8. The T-shaped steel section bar for a support structure according to claim 1, wherein the section bar comprises a single zinc coated galvanized steel strip or single zinc coated galvanized steel sheet metal folded on itself to define an overlap of walls, wherein each of the two walls includes an end portion provided with at least one corrugation.

9. A combination comprising:

the T-shaped steel section bar of claim 1; and a clip or connection article, having elongation ability greater than the elongation ability of the T-shaped steel section bar, the combination is configured to indirectly join the T-shaped steel section bar to another metal section bar via the clip or connection article.

10. The combination according to claim 9, wherein said clip is suitable for being fixed to said section bar and includes a plate sheet metal body having at least one through hole, said plate sheet metal body comprising at least one deformed sheet metal portion, said deformed sheet metal portion being protruding from one face of said plate sheet metal body and surrounding at least partially said through hole of the clip, wherein said section bar has at least one through hole intended to be aligned to the through hole of the clip, wherein said deformed sheet metal portion of the clip is inserted in the through hole of the section bar and wherein the deformed sheet metal portion has an insertion clip portion received in the through hole of the section bar, and a riveted clip portion that protrudes radially with respect to the insertion portion of the clip.

11. The combination according to claim 10, wherein said deformed sheet metal portion is a deep-drawn sheet metal portion.

12. The combination according to claim 9, wherein said clip has a thickness greater than a thickness of the section bar.

13. A support structure for a false ceiling including the combination according to claim 9.

14. A process for making a T-shaped steel section bar for supporting of false ceilings, comprising the steps of:

providing a zinc coated galvanized steel strip or zinc coated galvanized steel sheet metal of thickness equal to or lower than 0.25 mm; and folding the zinc coated galvanized steel strip or zinc coated galvanized steel sheet metal to obtain the T-shaped steel section bar for supporting of false ceilings, wherein the steel of said galvanized steel strip or galvanized steel sheet metal has the following combination of features:

maximum tensile strength from 500 N/mm$^2$ to 1000 N/mm$^2$; and elongation of from 2% to 8%.

15. The process according to claim 14, wherein said zinc coated galvanized steel strip or zinc coated galvanized steel sheet metal has maximum tensile strength RM from 650 N/mm$^2$ to 850 N/mm$^2$.

16. A support structure for a false ceiling including the T-shaped steel section bar of a support structure as set forth in claim 6.

17. The process according to claim 14, wherein the zinc coated galvanized steel strip or zinc coated galvanized steel sheet metal includes a steel strip or steel sheet metal and a zinc coating applied on a surface of the steel strip or steel sheet metal and wherein the process further includes a step of cleaning the surface of the steel strip or steel sheet metal to remove any oily portions and/or surface oxides before applying the zinc coating.

18. The combination according to claim 9, wherein said clip is of stainless steel.

19. The process according to claim 14, wherein the T-shaped steel section bar has at least one through hole, the process further comprising:

providing a clip or connection article having an elongation ability greater than the elongation ability of the T-shaped steel section bar, the clip or connection article including a plate sheet metal body having at least one through hole;

placing the clip or connection article on the T-shaped steel section bar by aligning the at least one through hole of the clip or connection article with the at least one through hole of the T-shaped steel section bar;

deep drawing a portion of the plate sheet metal body surrounding at least partially the at least one through hole of the clip or connection article into the at least one through hole of the T-shaped steel section bar, thus forming a deep drawn portion of the plate sheet metal portion partly received in the at least one through hole of the T-shaped steel section bar and partly protruding from the at least one through hole of the T-shaped steel section bar, whereby the deep drawn portion comprises a partly received portion and a partly protruding portion; and fixing the clip or connection article to the T-shaped steel section bar by riveting the partly protruding portion of the deep drawn portion against the T-shaped steel section thus forming a riveted portion of the deep drawn portion protruding radially with respect to the partly received portion.

* * * * *